United States Patent [19]

Kishi et al.

[11] Patent Number: 4,675,268

[45] Date of Patent: Jun. 23, 1987

[54] PROCESS FOR TRANSFER OF A TONER IMAGE UTILIZING A MAGNETIC TONER CONTAINING A BINDER RESIN AND HAVING GRADUAL SOFTENING CHARACTERISTICS

[75] Inventors: Ken-ichi Kishi; Kenzi Tuzita; Tuneo Daidoji; Yuki Okuyama; Kiyoshi Kimura, all of Hachioji, Japan

[73] Assignee: Konishiroku Photo Industry Co., Ltd., Tokyo, Japan

[21] Appl. No.: 838,889

[22] Filed: Mar. 11, 1986

Related U.S. Application Data

[60] Continuation of Ser. No. 751,476, Jul. 3, 1985, abandoned, which is a division of Ser. No. 530,602, Jul. 19, 1983, abandoned.

[30] Foreign Application Priority Data

| | | | |
|---|---|---|---|
| Nov. 26, 1981 | [JP] | Japan | 56-188314 |
| Nov. 26, 1981 | [JP] | Japan | 56-188315 |
| Nov. 26, 1981 | [JP] | Japan | 56-188316 |
| Nov. 26, 1981 | [JP] | Japan | 56-188317 |

[51] Int. Cl.[4] ..... G03G 13/16

[52] U.S. Cl. ..... 430/126; 430/106.6

[58] Field of Search ..... 430/109, 126, 110, 106.6

[56] References Cited

U.S. PATENT DOCUMENTS

| | | | |
|---|---|---|---|
| 3,898,171 | 8/1975 | Westdale | 430/109 |
| 4,108,653 | 8/1978 | Peters | 430/109 |
| 4,386,147 | 5/1983 | Seimiya et al. | 430/109 |

*Primary Examiner*—John L. Goodrow

*Attorney, Agent, or Firm*—Frishauf, Holtz, Goodman & Woodward

[57] ABSTRACT

This invention relates to a magnetic toner (3*b*) composed mainly of a magnetic material and a binder resin, in which the difference between the softening point and the softening initiation temperature of said magnetic toner (3*b*) is made 5° C. or more to provide a magnetic toner (3*b*) which is suitable for pressing transfer, particularly pressing transfer by use of an intermediate transfer member and capable of giving stable running characteristics without causing off-set phenomenon according to a conventional developing system without use of no special developing system and regardless of the photosensitive member employed as well as good image quality on a plain paper.

5 Claims, 2 Drawing Figures

PROCESS FOR TRANSFER OF A TONER IMAGE UTILIZING A MAGNETIC TONER CONTAINING A BINDER RESIN AND HAVING GRADUAL SOFTENING CHARACTERISTICS

This application is a continuation of Ser. No. 751,476 filed July 3, 1985 now abandoned, which is a division of Ser. No. 530,602, filed July 19, 1983 now abandoned.

This invention relates to a magnetic toner to be provided for development of electrostatic images, more particularly to an electroconductive magnetic toner to be provided for development of electrostatic images in electrostatic recording or electrophotography including pressing transfer process.

BACKGROUND OF THE INVENTION

In the prior art, as the developer of electrostatic images, there has been used the so-called two-component system developer comprising a mixture of a carrier and a toner. This developer charges the carrier and the toner through friction by stirring to polarities opposite to each other, and the charged toner is adhered electrostatically to the electrostatic image having the opposite polarity thereby to effect development, and therefore only the toner is consumed as the development is repeated, whereby the ratio of carrier to toner becomes changed. For this reason, for obtaining adequate images, the toner is required to be successively supplemented to maintain the mixing ratio at a constant value, whereby a complicated and expensive toner supplementing device must be provided. Also, as to the carrier, it is deteriorated through adhesion of fine powders of toner on its surface, etc. during usage for a long term, whereby unfavorable phenomena are brought about such as lowering of image density and increase of ground contamination. For this reason the carrier must also be exchanged periodically with new. The above problems are not substantially overcome in a developer using the so-called coated carrier having the surfaces of carrier particles coated with a resin.

In order to remove the drawback of the two-component system developer as described above, there is proposed the so-called one-component system developer containing no carrier. This developer comprises a magnetic toner, comprising fine magnetic material powders dispersed in a thermoplastic resin, optionally with incorporation of carbon black and/or a dye dispersed therein, followed by pulverization.

The magnetic toners may be broadly classified into the so-called electroconductive toner having relatively lower resistance and the so-called insulating toner having relatively higher resistance.

The important factors influencing the image quality when forming images according to xerographic process are the developing characteristics and transfer characteristics. In the aforesaid electroconductive toner, since the development proceeds based on the electrostatic induction by the electrostatic charges, no true charge is required for the toner. Therefore, there is the advantage that no harmful fluctuation of development occurs through constant fluctuations of its value depending on humidity, but there is the drawback that "blur" is formed on the transferred image by occurrence of disturbance of the electrical force line when tranferring the toner image onto a transfer paper by an electrostatic transfer means. On the other hand, the insulating toner has a true charge of the opposite polarity to the latent image charge, and development proceeds through electrical attraction between the true charge of the toner and the latent image charge. Such an insulating toner has the drawback that development characteristic is poor because of constant fluctuation of the true charge of the toner depending on humidity, but it has the advantage that a transferred image without "blur" can be obtained without disturbance of electrical force line when transferring the toner image onto transfer paper by an electrostatic means. Such electroconductive toner and insulating toner have developing characteristics and transfer characteristics which are opposite to each other, and therefore there is involved the problem that is is difficult to obtain stable images of good quality by development with the use of either one of the toners.

As a means for solving such a problem, there has been attempted, for example, the method in which an electroconductive magnetic toner is used for development, on one hand, and a coated paper with resin coating is used to prevent disturbance of the electrical force line during transfer for improvement of transfer characteristic. However, such a coated paper requires additional working resulting increased cost, and the original merit of the transfer system capable of using a plain paper is lost. Alternatively, attempts to improve developing characteristic by the use of an insulating toner have also been made.

For example, Japanese Provisional Patent Publication No. 31136/1978 discloses a developing system in which the toner is charged and the bias voltage is also applied. Also, Japanese Provisional Patent Publications No. 118056/1978 and No. 22835/1979 disclose development with a mixture of two kinds of magnetic toners with different resistances. And, Japanese Provisional Patent Publication No. 42141/1979 discloses a technique, in which developing characteristic is improved by making the toner layer at the developing section extremely thin, thereby making shorter the distance between the photosensitive member and the toner carrier (e.g. non-magnetic sleeve).

Even by the use of an insulating magnetic toner, considerable improvements of developing characteristic can be seen in the methods as mentioned above, but it has not yet reached the region of an electroconductive toner. Moreover, there also remained the drawbacks that the development device was required to be specially elaborated and that the mixing ratio of the two kinds of magnetic toners with different electric resistances was changed with the number of copies.

The present inventors have already proposed an image forming method disclosed in Japanese Provisional Patent Publication No. 168674/1981 as the method for solving these problems. That is, this method comprises performing pressing transfer of a toner image comprising an electroconductive toner formed on an image supporting member onto an intermediate transfer member, and fixing thermally the toner image by pressing transfer onto the final transfer member. According to such a method, developing characteristic is excellent due to the use of an electroconductive toner for development, and also no destruction or deformation of the three-dimensional accumulated body of the toner image is accompanied due to employment of the pressing transfer method in place of the transfer method by electrostatic means, whereby transferred images can be formed faithfully to the original images, to result in both excellent developing characteristic and excellent transfer characteristic, to find that final image of good quality can be obtained. However, when images are formed continuously, the thermal transfer conditions will be changed constantly depending on the changed in temperature or humidity conditions of the atmosphere, changes of the heating temperature of the image forming device, to find that images of good quality can not necssarily be obtained. For example, the viscoelastic property of the toner to be transferred and fixed is changed due to the temperature change during thermal transfer, whereby the softened toner cannot be sufficiently transferred onto the final transfer member (usually, transfer paper) but remains on the intermediate transfer member, which residual image is retransferred to the photosensitive member or a transfer paper subsequently delivered, etc. to cause the so-called off-set phenomenon, thereby deteriorating the image quality. Other disadvantages that occured were that fixing of the toner image was insufficient during thermal transfer, or the three-dimensional accumulated body of the toner image may be destroyed or deformed due to excessive fixing to worsen the image quality.

To cope with the unexpected phenomena as mentioned above, the present inventors have made extensive studies about the influences of thermal characteristics of the magnetic toner upon the image quality, and surprisingly found that the difference between the softening point and the softening initiating temperature of the magnetic toner is related to the image quality, and the present invention has been accomplished on the basis of this knowledge.

SUMMARY OF THE INVENTION

An object of this invention is to provide a pressing transfer utilizing a magnetic toner, particularly pressing transfer by the use of an intermediate transfer member, and can give stable running characteristics without occurrence of off-set phenomenon and also good image quality on plain papers using a conventional developing system and irrespectively of the kind of photosensitive member employed.

Such an object of this invention can be accomplished by a magnetic toner comprising a magnetic material and a binder resin, characterized in that the difference between the softening point and the softening initiating temperature of said magnetic toner is 5° C. or more.

This invention is described in further detail below.

In this invention, the softening point of a magnetic toner is defined as the temperature at h/2, wherein h is the height of the S-curve in the plunger depression-temperature curve (softening flow curve) of the flow tester, h is the height of the S-curve in the plunger depression temperature curve (softening flow curve) of the flow tester, when a sample of a magnetic toner in an amount of 1 $cm^3$ is subjected to measurement and recording by the use of a flow tester according to the Model of Society of Polymer Chemistry of Japan (produced by Shimazu Seisakusho Co.) under the conditions of a load of 20 $Kg/cm^2$, a nozzle diameter of 1 mm, a nozzle length of 1 mm and a temperature elevation speed of 6° C./min. On the other hand, the softening initiating temperature is defined as the temperature at h/10 in the above measuring method.

The present invention can be accomplished by employment of, for example, at least one kind of the three concrete means as described below.

That is, in the first place, this invention can be accomplished by a toner, comprising a magnetic material and a binder resin, characterized in that said magnetic material comprises a mixture of at least two kinds of magnetic material components and the difference in oil absorption between at least two kinds of the magnetic material components is 3 ml/100 g or more.

Secondly, this invention can be accomplished by a toner comprising a magnetic material and a binder resin, characterized in that said binder resin comprises a mixture of at least two kinds of resin components, and at least two kinds of said resin components are capable of forming toners with difference in softening point of 3° C. or more, when made into toners by using the respective components with equal amounts of the same magnetic material and/or the same electroconductive material.

Thirdly, this invention can be accomplished by a magnetic toner, comprising a magnetic material, a binder resin and an electroconductive material, characterized in that said electrocounductive material comprises a mixture of at least two kinds of carbon blacks, and the difference in oil absorption between at least two kinds of the carbon blacks is 15 ml/100 g or more.

Magnetic material

The oil absorption in this invention refers to a minimum necessary amount of D.B.P. (dibutyl phthalate) to make a constant amount (100 g) of a magnetic material into a paste.

The magnetic material to be used in the magnetic toner according to this invention may be either conductive, semi-conductive or insulating. When it is conductive or semi-conductive, it is not required to incorporate an electroconductive material for the magnetic material as the electroconductive material to be used in this invention. However, this case is limited to magnetic toners according to this invention, having an electroconductivity of $10^{-4}$ to $10^{-12}$ ℧/cm in the direct current field of 1000 V/cm.

As the magnetic material to be used in the magnetic toner according to this invention, there may be employed known magnetic material powders conventionally used. More specifically, there may be included metal powders of cobalt, iron, nickel, etc., fine powders of alloys of metals such as aluminum, cobalt, copper, iron, lead, nickel, magnesium, tin, zinc, gold, silver, selenium, titanium, tungsten and zirconium and mixtures thereof, metal oxides such as aluminum oxide, iron oxide, nickel oxide and metal compounds containing these and strongly magnetic ferrites, and mixtures thereof. These powders may be formulated in an amount of 10 to 80% by weight, preferably 35 to 65% by weight, based on the total amount of the toner. Some of these may exhibit the effect as an electroconductive material or a colorant, and in such a case, the toner according to this invention can accomplish the object of this invention without addition of an electroconductive material or a colorant. These magnetic materials may have surfaces which are modified by treatment with titanium and silane coupling agents.

As to the mixing ratio of the different magnetic materials, it is different depending on the resin or the electroconductive material employed and not particularly limited, but they should be mixed so that the difference between the softening point and the softening initiating temperature may be 5° C. or more, and this can be easily determined by experimentation by those skilled in the art.

The oil absorption of the magnetic material is not also particularly limited, but it is desirably 10 to 80 ml/100 g for preventing elevation of the toner softening point, and the difference in oil absorption between the two kinds or more of magnetic materials, which is not also particularly limited, may be practically preferred to be 5 ml/100 g or more.

Binder resin

In this invention, the same extent of electroconductivity of magnetic toner refers to the same extent order of the electroconductivity measurement values exhibited by the magnetic toner of this invention under the direct current applied electric field of 1000 V/cm, and the electroconductivity mentioned in this invention is determined by placing a sample in a cell for measurement with a sectional area of 1 $cm^2$ (F $cm^2$) to a depth of 0.03 to 0.08 cm (h cm), applying a load of 1 Kg on the upper surface, measuring the current value (i ampere) when the applied voltage (V volt) is varied and calculating according to the following formula:

$$\text{Electroconductivity } \rho(\mho/\text{cm}) = \frac{i \times h}{V \times F}$$

As the binder resin to be used for the magnetic toner according to this invention, thermoplastic resins may desirably be employed, as exemplified by polymers of styrene or derivatives thereof such as polystyrene, polyvinyltoluene and the like; copolymers of styrene or derivatives thereof such as styrene-butadiene copolymers, styrene-acrylic acid copolymers, styrene-maleic anhydride copolymers and the like; polyester resins, acrylic resins, xylene resins, polyamide resins, ionomer resins, ketone resins, terpene resins, phenol-modified terpene resins, rosin, rosin-modified resins, maleic-modified phenol resins, petroleum type resins, starch graft polymers, polyvinyl alcohol, polyvinyl pyrrolidone and so on. These resins may be used alone or as a mixture in an amount ranging from 30 to 65% by weight based on the total amount of the toner. In this invention, a styrene type resin and a polyester resin are particularly preferred.

Also, the mixing ratio of the different resins of this invention differs depending on the magnetic material and the electroconductive material employed and is not particularly limited, but they should be mixed so that the difference between the softening point and the softening initiating temperature may be 5° C. or more, and this can easily be determined by experimentation by those skilled in the art.

Even by the use of similar resins, when they have different compositions or average moleqular weights, two or more kinds thereof can be mixed to increase the difference between the softening point and the softening initiating temperature of the magnetic toner. As to the extent of difference between the compositions and the average molecular weights, there is no particular limitation but any extent of difference may be utilized, so far as the above temperature difference of the magnetic toner can be made 5° C. or more.

Electroconductive material

The oil absorption in this invention refers to a minimum necessary amount of D.B.P. (dibutyl phthalate) for making a constant amount (100 g) of carbon black into paste.

Carbon black has the advantage of improving image density and lustre as the increase of the amount added and may preferably be used.

The mixing ratio of carbon blacks with different oil absorptions in this invention, which is different depending on the resin employed and not particularly limited, may be such that the difference between the softening point and the softening initiating temperatre may be 5° C. or more, and this can be determined easily by experimentation by those skilled in the art. The oil absoption of carbon black is not also particularly limited, but desirably 400 ml/100 g or less for preventing elevation of the toner softening point. As the carbon black to be used for the magnetic toner of this invention, there may be included furnace type, channel type and acetylene type carbon blacks.

Other electroconductive materials than carbon black may also be used in the magnetic toner according to this invention. As other electroconductive materials, there may be included highly electroconductive materials such as silver, copper, aluminum, iron, etc., electroconductive organic polymers such as polymers having ionic polar groups, varnish having metallic particles dispersed in a vehicle, etc. and metal soaps which are salts of organic acids such as stearic acid with alkali metals, alkaline earth metals and transition metals, and these may be used singly or as a mixture in an amount ranging from 1 to 30%. by weight based on the total amount of the toner.

For the magnetic toner according to this invention, it is also possible to use other additives, if necessary, such as characteristic improving agents, colorants and agents for improving free flow characteristic. The characteristic improving agent to be added for further improvement of the so-called off-set phenomenon comprises a mold-release material such as higher fatty acids and derivatives thereof, higher alcohols, paraffins, waxes, etc., which may be used in an amount of 0.2 to 20% by weight based on the total amount of the toner. The colorants for image density controller or color adjustment, suitable known pigments or dyes may be available. Typical examples may include Nigrosin dyes, Aniline Blue, Calcooil Blue, Chrome Yellow, Ultramarine Blue, Aniline Yellow, Methylene Blue Chloride, Phthalocyanine Blue, Rose Bengal and mixtures thereof. When these colorants are to be used, it is desirable to use them in an amount of 1 to 20% by weight based on the total amount of the toner. As the agent for improving free flow characteristic, there may preferably be employed $SiO_2$, $TiO_2$ and $Al_2O_3$ in an amount ranging from 0.05 to 10% by weight based on the total amount of the toner.

Any of the combinations of the toner components as described above may be used, so long as the difference between the softening point and the softening initiating temperature may be 5° C. or more. Accordingly, its combination can be varied suitably depending on the purpose of the use. As to the preferable combinations of toner components to be provided for use in pressing transfer with an intermediate transfer member, reference should be made to Examples.

Physical properties of magnetic toner

The difference between the softening point and the softening initiating temperature is 5° C. or more.

The softening point of the magnetic toner, which is not particularly limited, may preferably be 170° C. or lower and 80° C. or higher, more preferably 135° C. or lower and 100° C. or higher, for the reasons such as saving of heat energy at the time of fixing and prevention of temperature elevation within a copying machine.

The electroconductivity of the magnetic toner according to the present invention may be a value enough to exhibit behaviors as an electroconductive toner in the system in which the magnetic toner is to be employed, but preferably $10^{31\ 4}$ to $10^{-12}$ ℧/cm in the direct current field of applied electric field 1000 V/cm. The "electroconductivity" used here has the same meaning as defined above.

The magnetic toner according to this invention may have a particle size of 1 to 50 μ, particularly preferably 7 to 30μ. A toner with a particle size less than 1 μ is liable to cause toner filming phenomenon on an image forming member, thus tending to cause contamination of transfer papers, while a toner with a particle size in excess of 50 μ is undesirbly liable to cause coarsening of the image quality.

Mechanism of the invention

The mechanism, enabling the difference between the softening point and the softening initiating temperature of the aforesaid magnetic toner to be 5° C. or more, by constituting the magnetic toner of two or more kinds of magnetic materials, carbon black with different oil absorptions and two or more kinds of binder resins with different softening points, may be estimated as follows.

That is, in the magnetic toner, when using either one of the components of magnetic material, binder resin and carbon black which are constituents thereof as a mixture of two or more kinds, it has been found by the studies by the present inventors that the difference between the softening point and the softening initiating temperature of the magnetic toner is broadened through the difference in binding force or affinity force between the respective components, said difference being influenced by the oil absorptions of magnetic materials, carbon blacks and the softening points of binder resins. Accordingly, by permitting a mixture of two or more kinds of magnetic materials, carbon blacks with different oil absorptions or binder resins with different softening points to be present in the same toner particles, the softening flow curve of the resultant toner may be expressed as the sum of the softening flow curves of the toners using individually single component. As the result, it may be estimated that a broad curve can be drawn, in other words, the difference between the softening point and the softening initiating temperature becomes broadened.

On the other hand, the mechanism to provide stable running characteristics without off-set phenomenon and good images, when the difference between the softening point and the softening initiating temperature of the magnetic toner according to this invention is 5° C. or more, may be estimated approximately as follows.

In short, it may be considered that, if the temperature of the transfer paper at the time of transfer is supposed to lie between the toner softening point and softening initiating temperature, the state of the toner such as viscoelasticity is moved or deviated through a slight movement or deviation of the temperature of the transfer paper, when the difference between both temperatures is small, to result in bringing about the state under which off-set phenomenon is liable to occur, and also bringing about ununiformity in image quality during running.

Preparation example of magnetic toner

The magnetic toner according to this invention may be prepared according to any method known in the art, as exemplified by the method in which a toner starting material is kneaded at one time or dividedly by means of a hot roll, heated kneader or a heated co-kneader, cooled, crushed and classified, the method in which a toner starting material is dissolved, dispersed or suspended at one time or dividedly in an appropriate solvent, followed by spray drying treatment, or various polycondensation methods such as interfacial polycondensation, suspension polycondensation or solution polycondensation, and others.

Example of Use of Magnetic Toner

By the use of the magnetic toner according to this invention, the toner image obtained may be subjected once to pressing transfer onto an intermediate transfer member provided at the intermediate position between a photosensitive drum and a plain paper according to pressing transfer (typically tacky transfer), whereby the magnetic toner according to this invention can be travelled adhered on the surface of the above intermediate transfer member through the tacky force on the surface of the above intermediate transfer member and the charge force retained on the magnetic toner image without destroying the resolution performance of the magnetic toner image, followed subsequently by thermal transfer and fixing onto a final transfer medium, namely a plain paper, through its viscoelastic changes. If desired, it is also possible to perform subsequently supplementary heat fixing to enhance the fixing characteristic.

This point is now described in detail. The aforesaid intermediate transfer member may be any material which can transfer the toner, generally comprising at least the surface of transfer member (transfer layer) of natural rubber, urethane rubber, styrene-butadiene rubber, silicone rubber, ethylene-propylene rubber and fluorine rubber. Among silicone rubbers, those obtained by low temperature vulcanization or room temperature vulcanization are suitable. Said natural rubber is a conventional natural rubber, comprising primarily poly-cis-1,4-isoprene; the urethane rubber is a rubber, comprising constituent units of urethane bondings formed by the reaction between diisocyanate and glycols or diamines, as exemplified by commercially available Vulkollan [produced by Sumito-Bayer Urethane Co.], Hiprene [produced by Mitsui Toatsu Kagaku Co.], Desmopan [produced by Sumitomo-Bayer Urethane Co.], Estane [produced by Goodrich Co.] and Adiprene [produced by Du Pont Co.]; and the styrene-butadiene rubber is a copolymer of styrene monomer and butadiene monomer, generally enriched in butadiene monomer components. Silicone rubbers include various kinds of silicone rubbers, but methyl silicone rubber, methyl vinyl silicone rubber and methyl phenyl silicone rubber are generally used. A fluorine rubber contains fluorine atoms in the polymer molecules, and may be exemplified by ethylene trifluoride-vinylidene fluoride copolymer, propylene pentafluoride-vinylidene fluoride copolymer, propylene hexafluoride-vinylidene fluoride copolymer [(e.g. Baidon, produced by Du Pont Co.], ethylene chloride trifluoride-vinylidene fluoride copolymer, fluorine-containing nitroso rubber, 1,1-dihydroperfluorobutyl acrylate rubber, etc.

In addition, as the material for transfer layer, there may also be included synthetic natural rubber [Califlex IR, produced by Shell Chemical Co.], ethyelene-propylene rubber [Nodel, produced by Du Pont Co.], acrylonitrile-butadiene rubber [Hycar, produced by Nippon Zeon Co.], organic polysulfide rubber [Thiocol, produced by Thiocol Co.], acrylic ester copolymer rubber [Hycar 4021, produced by Goodrich Co.], organic polysiloxane rubber [Shinetsu Silicone, produced by Shinetsu Kagaku Co.] and the like.

The transfer layer constituted of these materials may preferably have a surface which is smooth and highly elastic, with a rubber hardness of 5° to 70°.

As silicone rubbers, there may preferably be employed commercially available products such as KE-40, 41, 42, 42S, KE-441, 44, 45, 45S, KE-471, 47, 48, KE-67, 103, 1205, 1206, 1300, 1600, KE-12, 16, 17, 62, 1091, 1093, 1400 (all are of the type vulcanizable at room temperature), KE-104, 106, 1201, 1202, 1204, KE-1212, 1800 (all are of the type vulcanizable at low temperature) [all are produced by Shinetsu Kagaku Co.].

As the transfer member, there is generally used one having the aforesaid transfer layer material on a substrate of a metal such as stainless steel, nickel belt, etc., a polymeric film such as polyester, polyimide, polyimideamide, polysulfone, etc.

There is generally the upper limit of the amount of the toner adhered onto these transfer members. For example, 1.0 mg/cm$^2$ of toner can be adhered at the highest onto a transfer layer with a thickness of 50$\mu$ comprising a silicone rubber KE-1800 (rubber hardness 40°).

The image density corresponds to 1.0 when the amount of the toner adhered to the transfer member is 0.7 mg/cm$^2$, although the value may differ depending on the content of the colorant in the toner.

The transfer member may be either of the roller type rotating together with the image forming member as shown in FIG. 1 or an endless belt passing over at least two rotatary rollers rotating with the image forming member as shown in FIG. 2. The transfer member having transferred the toner image obtained by the toner according to this invention is previously heated, if desired, transfers the toner image onto a transfer paper, and the toner image is fixed simultaneously with or after transfer to be a permanent image. The fixing temperature may be the softening point of the toner according to this invention ±50° C., preferably the softening point of the toner ±30° C., more preferably the softening point of the toner ±20° C.

Referring now to the drawings, the image forming method preferably employed for the magnetic toner of this invention is to be described.

In FIG. 1, the imagewise electrostatic latent image formed on the electrostatic charge carrier 2*a* on the rotary drum 2 by the electrostatic image forming section 1 is moved to the developing section 3. In the developing section 3, the toner 3*b* of this invention ears up on the sleeve 3*a* by the magnet provided in the sleeve 3*a* and rotates toward the electrostatic carrier 2*a* and, after being trimmed in the way to constant heights by means of an ear cutter 3*c* is confronted with the electrostatic latent image at a certain distance therefrom, and countercharges are induced at the tips of ears which are accumulated columns of toner particles by the electrostatic latent images while being directly contacted therewith or passing with very slight gaps and thereafter contacted therewith, whereby the toner particles are moved in amounts proportional to the amount of charges of the electrostatic latent image successively toward the latent image side to form the toner image.

The toner image thus formed is transferred onto the transfer roller 4 contacted at about 0.1 Kg/cm$^2$ with the electrostatic charge carrier 2*a* within the tolerance of structural strength of the three-dimensional accumulated toner particles. The toner image is heated by the infrared heater 5 at near the transfer point to the copying paper 7 to be made mold releasable, and transferred and fixed onto the copying paper 7 between the transfer roller 4 and the pressing roller 6 pressed against said roller 4.

The rotary drum 2 having transferred the toner image onto the transfer roller 4 is subjected to static elimination at the static eliminating section 8, removed of the residual toner at the cleaning device 9, and thereafter recycled for use in the subsequent process. In the device shown in FIG. 1, when the electrostatic latent image forming section 1, the static eliminating section 8 and the cleaning device were made into non-actuated state, the electostatic latent image is not destroyed during transfer onto the transfer roller 4, whereby the so-called retention is rendered possible capable of forming the same imagewise toner image.

In the device shown in FIG. 2, there is shown an embodiment wherein a transfer belt is used as the transfer member. It is devised so that the squeeze vector of the toner relative to the three-dimensional accumulated particles may be minimum during transfer The toner image formed similarly as the embodiment as described with reference to FIG. 1 is transferred by the transfer roller 10 onto the transfer belt 13 contacted with the electrostatic charge carrier 2*a* at a pressure adjusted to about 0.15 Kg/cm$^2$. The transfer belt 13 is passed over between the transfer roller 10; the pressure contact roller 11 and the tension roller 12, and the toner image on the electrostatic charge carrier 2*a* is transferred by pressing onto the transfer belt 13 through the pressure contact with the transfer roller 10. The transfer belt 13 having transferred the toner image is moved toward the direction of the arrow, heated at near the point for transfer to the copying paper 7 by means of an infrared heater 5 to be made mold releasable, whereby the image is transferred from the transfer belt 13 to the copying paper 7 while passing through the pressure contact roller 11 and the roller 6.

The device shown in FIG. 2 is also capable of retention similarly as the devide shown in FIG. 1.

The transfer belt 13 after having transferred the toner image onto the copying paper 7 is subjected to cleaning of residual toner and paper powders of copying paper at the belt cleaning device 14, and further the transfer belt 13 can be destaticized at the transfer surface of said belt by means of the destacizing device 15. As the cleaning method, there may be employed a roller having provided felt, etc. on the peripheral surface, or a blade made of a rubber, or a scraper made of a polymer material or a metal.

As the destaticizing device, is frequently used a corona discharger or a ribbon comprising electroconductive fibers.

These belt cleaning devices and the destaticizing devices are clearly applicable for the device shown in FIG. 1.

The magnetic toner according to this invention may be used most suitably for pressing transfer, but it is not limited thereto, but also useful as an electroconductive toner in other uses in general.

BRIEF DESCRIPTION OF THE DRAWINGS

The drawings show typical examples of the device of the pressing tranfer method for which the magnetic toner of this invention can suitably be used, FIG. 1 showing an embodiment in which a tacky transfer roller is used and FIG. 2 an embodiment in which a tacky transfer belt is used.

BEST MODE FOR PRACTICING THE INVENTION

Figure 1:
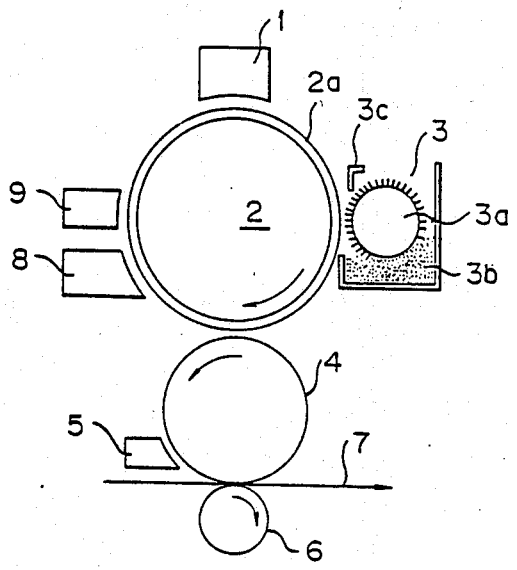

In order to describe in more detail about the magnetic toner according to this invention, Examples are shown below, but the embodiments of this invention are not limited thereto. In the following description, "parts" represents "parts by weight" unless otherwise particularly noted.

EXAMPLE 1

| | | | |
|---|---|---|---|
| Binder resin; | | Styrene-butyl acrylate copolymer (77:23) | 40 parts |
| Magnetic materials; | (1) | Trade name MG-W H-81-0402 (oil absorption 25 ml/100 g) | 20 parts |
| | (2) | Trade name MG-W H-81-0401 (oil absorption 30 ml/100 g) | 20 parts |
| | (3) | Trade name MG-W H-81-0518 (oil absorption 35 ml/100 g) (all produced by Mitsui Kinzoku Co.) | 20 parts |
| Carbon black; | | Trade name Conductex SC (produced by Columbia Carbon Co.) | 15 parts |

The above materials were well mixed and then kneaded by means of a kneader at 150° to 160° C. for 30 minutes. After cooling, the mixture was crushed into powders according to the ordinary method and classified to obtain a toner according to the present invention with an average particle size of 13.6 μ (hereinafter called as toner $A_1$).

Next, in place of the above magnetic materials, 30 parts of the trade name MG-W H-81-0402 (oil absorption 25 ml/100 g) and 30 parts of the trade name MG-W H-81-0401 (oil absorption 30 ml/100 g) were employed, under otherwise the same conditions in the above procedure, to obtain a toner according to the present invention with an average particle size of 13.7 μ (hereinafter called as toner $B_1$). Further, in place of the above magnetic materials, 50 parts of the trade name MG-W H-81-0518 (oil absorption 35 ml/100 g), under otherwise the same conditions as the above procedure, to obtain a toner for comparative purpose with an average diameter of 13.6μ (hereinafter called as toner $C_1$). The characteristic values of the toners $A_1$, $B_1$ and $C_1$ obtained here are listed in Table 1.

TABLE 1

| | toner: | | |
|---|---|---|---|
| Characteristic values: | Toner $A_1$ | Toner $B_1$ | Toner $C_1$ |
| Softening point (°C.) | 130 | 129 | 138 |
| Softening initiating temperature (°C.) | 121 | 123 | 134 |
| Electroconductivity (℧/cm) | $3.6 \times 10^{-6}$ | $3.8 \times 10^{-6}$ | $3.2 \times 10^{-6}$ |

As apparently seen from this Table, it can be understood that the difference between the softening point and the softening initiating temperature of a magnetic toner can be made greater by the use of a mixture of magnetic materials with different oil absorptions.

Figure 2:
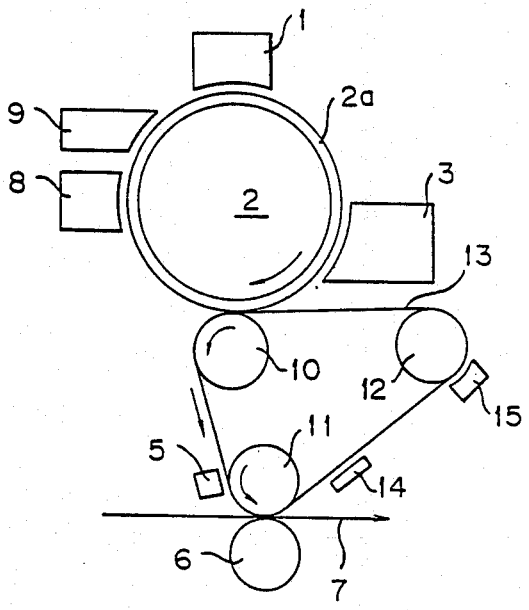

Running tests were conducted by means of the device as shown in FIG. 2 by the use of the above toners $A_1$, $B_1$ and $C_1$ to obtain the results concerning the off-set characteristics as shown in Table 2. The photosensitive member employed was selenium, and the transfer member employed was an endless beld comprising a polyimide substrate coated with silicon rubber. Also, the roller 6 was set at 145° C., while the roller 11 at 120° C.

TABLE 2

| | Number of copies: | | | | |
|---|---|---|---|---|---|
| Toner: | 1-100 | 2000 | 5000 | 10,000 | 20,000 |
| Toner $A_1$ | Very good | Very good | Very Good | Very Good | Good |
| Toner $B_1$ | Very good | Very good | Very Good | Good | Good |
| Toner $C_1$ | Very good | Good | Ordinary | Bad | Very bad |

As apparently seen from Table 2, the magnetic toners according to this invention (toner $A_1$ and toner $B_1$) are good without off-set phenomenon.

EXAMPLE 2

| | | | |
|---|---|---|---|
| Binder resin: | | Polyamide resin (trade name: Barsamide 940, produced by Nippon General Mills Co.) | 40 parts |
| Magnetic materials: | (1) | Trade name RB-BL (oil absorption 22 ml/100 g) | 30 parts |
| | (2) | Trade name BL-200 (oil absorption 28 ml/100 g) (both are produced by Titanium Kogyo Co.) | 30 parts |
| Carbon black: | | Trade name Ketchen EC (produced by Lion Yushi Co.) | 7 parts |

The above materials were well mixed and then treated in the same manner as described above to obtain a toner according to the present invention with an average particle size of 14.0 μ (hereinafter called as toner $D_1$).

Next, the same procedure was repeated except for using 60 parts of RB-BL in place of the above magnetic materials to obtain a toner for comparative purpose with an average particle size of 13.9 μ (hereinafter called as toner $E_1$).

Further, the same procedure was repeated except for using 60 parts of BL-200 in place of the above magnetic materials to obtain a toner for comparative purpose with an average particle size of 13.8 μ (hereinafter called as toner $F_1$).

The characteristic values of the toners $D_1$, $E_1$ and $F_1$ obtained here are listed in Table 3.

TABLE 3

| | toner: | | |
|---|---|---|---|
| Characteristic values: | Toner $D_1$ | Toner $E_1$ | Toner $F_1$ |
| Softening point (°C.) | 114 | 112 | 117 |
| Softening initiating temperature (°C.) | 108 | 110 | 113 |
| Electroconductivity (℧/cm) | $8.6 \times 10^{-6}$ | $9.0 \times 10^{-6}$ | $8.8 \times 10^{-6}$ |

As can be seen also from Table 3, it can be understood that the difference between the softening point and the softening initiating temperature of a magnetic toner can be made greater by the use of two or more magnetic materials with different oil absorptions.

Using the toners $D_1$, $E_1$ and $F_1$, image formations were conducted by means of the same device as in Example 1 (but the roller 6 was set at 130° C., and the roller 11 at 100° C., and the photosensitive member was replaced with OPC), whereby the running performance of the toner $D_1$ was good to give also good image quality.

The above photosensitive member OPC was prepared by dissolving 1 part by weight of Chlorodian Blue (bis-azo pigment) in 140 parts by weight of a 1.2 : 1.0 : 2.2 mixture of ethylenediamine, n-butylamine and tetrahydrofuran and coating the solution to obtain a coated amount corresponding to 1 μ after drying to form a carrier generating layer, then dissolving 6 parts by weight of 1-phenyl-3-(p-diethylaminostyryl)-5-(p-diethylamino-phenyl) pyrazoline and 10 parts of a polyester "Byron 200" (produced by Toyo Boseki Co.) in 90 parts by weight of 1,2-dichloroethane, followed by coating of the resultant solution to a film thickness after drying of 10 μ to form a carrier transporting layer, thus providing an electrophotographic photosensitive member.

EXAMPLE —3

Example 1 was repeated, except that 40 parts of styrene-butyl acrylate resin (70 : 30) were employed in place of the binder resin in Example 1 and a mixture of 30 parts of a magnetic material (trade name RB-BL, produced by Titanium Kogyo Co., oil absorption 22 ml/100 g) with 30 parts of another magnetic material (trade name BL-SP, produced by Titanium Kogyo Co., oil absorption 25 ml/100 g) in place of the magnetic material mixture, to obtain a toner according to this invention with an average particle size of 14.8 μ (hereinafter called as toner $G_1$).

For comparison, using 30 parts of a magnetic material (trade name BL-SP, produced by Titanium Kogyo Co., oil absorption 25 ml/100 g) and 30 parts of another magnetic material (trade name SP-20, produced by Titanium Kogyo Co., oil absorption 23 ml/100 g) in place of the above magnetic materials, following otherwise the same procedure as described above, to obtain a toner for comparative purpose with an average particle size of 14.9 μ (hereinafter called as toner $H_1$).

The characteristic values of the toner $G_1$ and the toner $H_1$ were as shown in Table 4.

TABLE 4

| Characteristic values: | Toner: Toner $G_1$ | Toner $H_1$ |
|---|---|---|
| Softening point (°C.) | 124 | 125 |
| Softening initiating temperature (°C.) | 119 | 121 |
| Electroconductivity (℧/cm) | $5.8 \times 10^{-6}$ | $3.8 \times 10^{-6}$ |

As apparently seen from Table 4, it can be understood that the difference between the softening point and the softening initiating temperature of a magnetic toner can be made 5° C. or higher by a combination of two or more magnetic materials with a difference in oil absorption of 3 ml/100 g or more.

Running tests were also conducted using these toners similarly as in Example 1, with the roller 11 being set at 115° C. and the roller 6 at 140° C. As the result, off-set phenomenon became marked after about 10,000 sheets of copying for the $H_1$ toner, but substantially no off-set phenomenon was observed for the toner $G_1$.

EXAMPLE 4

| | | | |
|---|---|---|---|
| Binder resins: | (1) | Styrene-butyl methacrylate copolymer (60:40) [softening point 110° C.] | 30 parts |
| | (2) | Polyamide resin [trade name Barsamide 940 (produced by Nippon Generalmills Co.)] | 10 parts |
| Magnetic material: | | Trade name BL-100 (produced by Titanium Kogyo Co.) | 60 parts |
| Carbon Black: | | Trade name Ketchen EC (produced by Lion Yushi Co.) | 7 parts |

The above materials were well mixed and then treated in the same manner as described above to obtain a toner according to this invention with an average particle size of 13.6 μ (hereinafter called as toner $A_2$).

Next, using 40 parts of the styrene-butyl methacrylate copolymer (60:40) in place of the above resins, following otherwise the same procedure as described above, to obtain a toner for comprative purpose with an average particle size of 13.5 μ (hereinafter called as toner $B_2$).

Further, using 40 parts of the polyamide resin (trade name Barsamide 940) in place of the above resins, following otherwise the same procedure as described above, to obtain a toner for comprative purpose with an average particle size of 13.6 μ (hereinafter called as toner $C_2$).

The characteristic values of the toners $A_2$, $B_2$ and $C_2$ obtained here are listed in Table 5.

TABLE 5

| Characteristic values: | toner: Toner $A_2$ | Toner $B_2$ | Toner $C_2$ |
|---|---|---|---|
| Softening point (°C.) | 132 | 138 | 111.5 |
| Softening initiating temperature (°C.) | 125 | 134 | 109 |
| Electroconductivity (℧/cm) | $3.3 \times 10^{-6}$ | $3.1 \times 10^{-6}$ | $3.0 \times 10^{-6}$ |

As can be seen also from Table 5, it can be understood that the difference between the softening point and the softening initiating temperature of a magnetic toner can be made greater by mixing two or more binder resins.

EXAMPLE 5

| | | | |
|---|---|---|---|
| Binder resins: | (1) | Styrene-butyl acrylate copolymer (80:20) [softening point 105.6° C.] | 20 parts |
| | (2) | Styrene-butyl acrylate copolymer (75:25) [softening point 102.2° C.] | 20 parts |
| Magnetic material: | | Trade name BL-120 (produced by Titanium Kogyo Co.) | 60 parts |
| Carbon Black: | | Trade name Ketchen EC (produced by Lion Yushi Co.) | 7 parts |

The above materials were well mixed and then treated in the same manner as described above to obtain a toner according to this invention with an average particle size of 13.7 μ (hereinafter called as toner $D_2$).

Next, using 40 parts of the styrene-butyl acrylate copolymer (80:20) in place of the above binder resins, following otherwise the same procedure as described above, to obtain a toner for comprative purpose with an average particle size of 13.6 μ (hereinafter called as toner $E_2$).

Further, using 40 parts of the the styrene-butyl acrylate copolymer (75:25), following otherwise the same procedure as described above, to obtain a toner for comprative purpose with an average particle size of 13.8 μ (hereinafter called as toner $F_2$).

The characteristic values of the toners $D_2$, $E_2$ and $F_2$ obtained here are listed in Table 6.

TABLE 6

| Characteristic values: | toner: Toner $D_2$ | Toner $E_2$ | Toner $F_2$ |
|---|---|---|---|
| Softening point (°C.) | 151 | 151 | 148 |
| Softening initiating temperature (°C.) | 146 | 147 | 144 |
| Electroconductivity (℧/cm) | $8.8 \times 10^{-6}$ | $9.3 \times 10^{-6}$ | $8.9 \times 10^{-6}$ |

As can be seen also from Table 6, it can be understood that the difference between the softening point and the softening initiating temperature of a magnetic toner can be made greater by mixing two or more similar resins, provided that they have different ratios of components.

EXAMPLE 6

| | | |
|---|---|---|
| Binder resins: | (1) Polyester resin (copolymer of a molar ratio of terephthalic acid:fumaric acid:bisphenol A of 1:1:2; weight average molecular weight: 2600, number average molecular weight: 2062; softening point 106° C.) | 24 parts |
| | (2) Polyester resin (the same composition as above; weight average molecular weight: 2952; number average molecular weight: 2337; softening point 109° C.) | 16 parts |
| Magnetic material: | Trade name BL-100 (produced by Titanium Kogyo Co.) | 60 parts |
| Carbon black: | Trade name Conductex 975 (produced by Columbia Carbon Co.) | 10 parts |

The above materials were well mixed and then treated in the same manner as described above to obtain a toner according to this invention with an average particle size of 13 μ (hereinafter called as toner $G_2$).

Next, in place of the above polyester resins was used a polyamide resin (trade name: Barsamide 940, produced by Nippon Generalmills Co.), following the same procedure as described above, to obtain a comparison for comparative purpose (hereinafter called as toner $H_2$).

The characteristic values of the toners $G_2$ and $H_2$ obtained here are shown in Table 7.

TABLE 7

| Characteristic values: | Toner: Toner $G_2$ | Toner $H_2$ |
|---|---|---|
| Softening point (°C.) | 131 | 111.5 |
| Softening initiating temperature (°C.) | 118 | 109 |
| Electroconductivity (℧/cm) | $1.6 \times 10^{-6}$ | $2.8 \times 10^{-6}$ |

As can be seen also from Table 7, it can be understood that the difference between the softening point and the softening initiating temperature of a magnetic toner can be made greater by mixing two or more similar resins with the same compositions, provided that they have different (weight, number) average molecular weights.

EXAMPLE 7

| | | |
|---|---|---|
| Binder resin: | Styrene-butyl acrylate copolymer (77:23) [weight average molecular weight 18,000, number average molecular weight 5,300] | 40 parts |
| Magnetic material: | Trade name BL-100 (produced by Titanium Kogyo Co.) | 10 parts |
| Carbon black: | Trade name Conductex 975 (produced by Columbia Carbon Co.) [oil absorption 160 ml/100 g] | 10 parts |

Using the above materials, the same treatment as in Example 1 was conducted to prepare a magnetic toner according to this invention with an average particle size of 13.8 μ (hereinafter called as toner $I_2$).

Next, the same procedure was repeated, except 7 parts of Ketchen EX (produced by Lion Yushi Co.) were employed in place of 10 parts of the above Conductex 975, to prepare a magnetic toner according to this invention with an average particle size of 13.5 μ (hereinafter called as $J_2$ toner).

The characteristic values of the toners $I_3$ and $J_3$ obtained here are listed in Table 8.

TABLE 8

| Characteristic values: | Toner: Toner $I_2$ | Toner $J_2$ |
|---|---|---|
| Softening point (°C.) | 127 | 140 |
| Softening initiating temperature (°C.) | 122 | 126 |
| Electroconductivity (℧/cm) | $2.6 \times 10^{-6}$ | $3.3 \times 10^{-6}$ |

EXAMPLE 8

| | | |
|---|---|---|
| Binder resin: | Styrene resin (Trade name PICCOLASTIC D-125, produced by Shell Chemical Co., weight average molecular weight/number average molecular weight = 45) | 40 parts |
| Magnetic material: | Trade name BL-100 (produced by Titanium Kogyo Co.) | 60 parts |
| Carbon Black: | Trade name Ketchen EC (produced by Lion Yushi Co.) [oil absorption 313 ml/100 g] | 7 parts |

Using the above materils, the same treatment as in Example 1 was applied to obtain a magnetic toner with an average particle size of 14.0 μ (hereinafter called as toner $K_2$).

Next, the above procedure was repeated except that the above carbon black was changed to 8 parts of Conductex SC (produced by Columbia Carbon Co.) to obtain a magnetic toner for comparative purpose with an average particle size of 14.2 μ (hereinafter called as toner $L_2$).

The characteristic values of the toners $K_3$ and $L_3$ obtained here are shown in Table 9.

TABLE 9

| Characteristic values: | Toner: Toner $K_2$ | Toner $L_2$ |
|---|---|---|
| Softening point (°C.) | 117.5 | 115 |
| Softening initiating temperature (°C.) | 107.5 | 111 |
| Electroconductivity (℧/cm) | $3.3 \times 10^{-6}$ | $5.2 \times 10^{-6}$ |

As apparently seen also from Tables 8 and 9, it can be understood that the difference between the softening point and the softening initiating temperature can be made considerably greater only by use of one kind of binder resin with a large molecular distribution.

EXAMPLE 9

Using the toners $A_2$-$L_2$ obtained in Examples 4–8, running tests were conducted in the same manner as in Example 1 to obtain the results concerning off-set characteristics as shown in Table 10. The roller temperatures employed are also shown in Table 10.

TABLE 10

| Toner: | Number of copies: 1–100 | 2000 | 5000 | 10,000 | 20,000 | Roller temperature (°C.) Roller 6 | Roller 11 |
|---|---|---|---|---|---|---|---|
| Toner $A_2$ | Very good | Very good | Very good | Very good | Good | 145 | 120 |
| Toner $B_2$ | Very good | Very good | Good | Ordinary | Bad | 150 | 125 |
| Toner $C_2$ | Bad | Bad | Bad | Very bad | — | 130 | 100 |
| Toner $D_2$ | Very good | Very good | Very good | Good | Good | 165 | 140 |
| Toner $E_2$ | Very good | Very good | Good | Ordinary | Bad | 165 | 140 |
| Toner $F_2$ | Very good | Very good | Good | Ordinary | Bad | 165 | 140 |
| Toner $G_2$ | Very good | Very good | Very good | Very good | Good | 145 | 120 |
| Toner $H_2$ | Slightly bad | Bad | Bad | Very bad | Very bad | 130 | 100 |
| Toner $I_2$ | Very good | Very good | Very good | Good | Ordinary | 145 | 120 |
| Toner $J_2$ | Very good | Very good | Very good | Very good | Good | 155 | 130 |
| Toner $K_2$ | Very good | Very good | Very good | Good | Good | 130 | 100 |
| Toner $L_2$ | Good | ordinary | Bad | Very bad | Very bad | 130 | 100 |

As is apparent from Table 10, it can be appreciated that the magnetic toner according to this invention can give images of good quality without off-set phenomenon.

Also, as the the surface potential of the photosensitive member used in this experiment, the magnetic toner according to this invention was found to be very little in fluctuations by repeated uses.

COMPARATIVE EXAMPLE

| | | |
|---|---|---|
| Binder resins: | polyamide resin | 20 parts |
| | (1) Trade name Barsamide 940 (produced by Nippon Generalmills Co.) | |
| | (2) Trade name Barsamide 930 (produced by Nippon Generalmills Co.) | 20 parts |
| Magnetic material: | Trade name BL-100 (produced by Titanium Kogyo Co.) | 60 parts |
| Carbon Black: | Trade name Conductex 975 (produced by Columbia Carbon Co.) | 10 parts |

According to the same procedure as in Example 1 by using the above materials, a magnetic toner for comparative purpose was obtained (hereinafter called as toner $m_2$).

Also, in place of the above binder resins, 40 parts of each of Barsamide 940 and Barsamide 930 was used individually, following otherwise the same procedure, to prepare magnetic toners for comparative purpose (hereinafter called as toner $N_2$ and toner $O_2$, respectively).

These toners had the characteristic values as shown in Table 11.

TABLE 11

| Characteristic values: | toner: Toner $M_2$ | Toner $N_2$ | Toner $O_2$ |
|---|---|---|---|
| Average particle size (μ) | 13.6 | 13.8 | 13.5 |
| Softening point (°C.) | 111 | 112 | 114 |
| Softening initiating temperature (°C.) | 107 | 110 | 112 |
| Electroconductivity (℧/cm) | $3.3 \times 10^{-6}$ | $3.9 \times 10^{-6}$ | $3.7 \times 10^{-6}$ |

As is apparent from Table 11, when the difference in softening point between the magnetic toners prepared from individual binder resins is less than 3° C., the difference between the softening point and the softening initiating temperature is 4° C. at the highest even when those resins are used in combination.

The results of the running tests conducted similarly as described above by use of these toners exhibited a slight effect by combined use only to the extent which was not practically useful.

EXAMPLE 10

| | | |
|---|---|---|
| Binder resin: | Styrene-butyl acrylate copolymer (77:23) | 40 parts |
| Magnetic material: | Trade name BL-100 (produced by Titanium Kogyo Co.) | 60 parts |
| Carbon Blacks: | (1) Trade name Conductex SC (oil absorption 110 ml/100 g) | 3 parts |
| | (2) Trade name Conductex 975 (oil absorption 160 ml/100 g) | 4 parts |
| | (3) Trade name Conductex 1528 (oil absorption 220 ml/100 g) (all produced by Columbia Carbon Co.) | 3 parts |

The above materials were mixed well, followed by the same treatment as described above to obtain a toner according to this invention with an average particle size of 13.7 μ (hereinafter called as toner $A_3$).

Next, in place of the above carbon blacks, 3 parts of Conductex SC and 7 parts of Conductex 975 were employed, following otherwise the same procedure, to obtain a toner according to this invention with an average particle size of 13.8 μ (hereinafter called as toner $B_3$).

Also, in place of the above carbon blacks, 8 parts of Conductex 1528 was employed, following otherwise the same procedure, to obtain a toner for comparative purpose with an average particle size of 13.7 μ (hereinafter called as toner $C_3$).

The characteristic values of the toners $A_3$, $B_3$ and $C_3$ obtained here are shown in Table 12.

TABLE 12

| Characteristic values: | toner: Toner $A_3$ | Toner $B_3$ | Toner $C_3$ |
|---|---|---|---|
| Softening point (°C.) | 131 | 132 | 133 |
| Softening initiating temperature (°C.) | 122 | 126 | 129 |
| Electroconductivity (℧/cm) | $2.6 \times 10^{-6}$ | $2.5 \times 10^{-6}$ | $2.6 \times 10^{-6}$ |

As apparently seen also from Table 12, it can be understood that the difference between the softening point and the softening initiating temperature of a magnetic toner can be made greater by the use of a mixture of carbon blacks with different oil absorptions.

EXAMPLE 11

| | | | |
|---|---|---|---|
| Binder resin: | | Polyamide resin [Trade name Barsamide 940, (produced by Nippon Generalmills Co.)] | 40 parts |
| Carbon Blacks: | (1) | Trade name Ketchen EC (produced by Lion Yushi Co.) [oil absorption 313 ml/100 g] | 3 parts |
| | (2) | Trade name Conductex 975 (produced by Columbia Carbon Co.) [oil absorption 160 ml/100 g] | 5 parts |
| Magnetic material: | | Trade name BR-RL (produced by Titanium Kogyo Co.) | 60 parts |

The above materials were well mixed and then treated similarly as described above to obtain a toner according to this invention with an average particle size of 13.8 μ (hereinafter called as toner $D_3$).

Next, in place of the above carbon blacks, 7 parts of Ketchen EC were used, following otherwise the same procedure, to obtain a toner for comparative purpose with an average particle size of 13.6 μ (hereinafter called as toner $E_3$).

Further, in place of the above carbon blacks, 10 parts of Conductex 975 were employed, following otherwise the same procedure, to obtain a toner for comparative purpose with an average particle size of 13.8 μ (hereinafter called as toner $F_3$).

Table 13 above the characteristic values of $D_3$, $E_3$ and $f_3$.

TABLE 13

| Characteristic values: | toner: Toner $D_3$ | Toner $E_3$ | Toner $F_3$ |
|---|---|---|---|
| Softening point (°C.) | 110 | 112 | 111 |
| Softening initiating temperature (°C.) | 105 | 110 | 109 |
| Electroconductivity (℧/cm) | $8.8 \times 10^{-6}$ | $9.0 \times 10^{-6}$ | $9.2 \times 10^{-6}$ |

EXAMPLE 12

By using the toners $A_3$–$F_3$ obtained in Examples 10 to 11, running tests were performed similarly as in Example 1 to obtain the results concerning off-set characteristics as shown in Table 14. The roller temperatures employed are also listed in Table 14.

TABLE 14

| Toner: | Number of copies: 1–100 | 2000 | 5000 | 10,000 | 20,000 | Roller temperature (°C.) Roller 6 | Roller 11 |
|---|---|---|---|---|---|---|---|
| Toner $A_3$ | Very good | Very good | Very good | Very good | Good | 145 | 120 |
| Toner $B_3$ | Very good | Very good | Very good | Good | Good | 145 | 120 |
| Toner $C_3$ | Very good | Good | Ordinary | Slightly bad | Bad | 145 | 120 |
| Toner $D_3$ | Very good | Very good | Good | Good | Good | 130 | 100 |
| Toner $E_3$ | Bad | Bad | — | — | — | 130 | 100 |
| Toner $F_3$ | Bad | Bad | — | — | — | 130 | 100 |

As is apparent from Table 14, it can be appreciated that the magnetic toners according to this invention (toners $A_3$, $B_3$ and $D_3$) are free from off-set phenomenon to give images which are stable and of good quality.

Also, as to the surface potential of the photosensitive member used in this Example, the magnetic toners were found to be very little in fluctuations by repeated uses.

EXAMPLE 13

| | | | |
|---|---|---|---|
| Binder resin: | | Styrene-butyl acrylate copolymer (70:30) | 40 parts |
| Magnetic material: | | Trade name BL-100 (produced by Titanium Kogyo Co.) | 60 parts |
| Carbon blacks: | (1) | Trade name Larben C beads (produced by Columbia Carbon Co.; oil absorption 120 ml/100 g) | 7 parts |
| | (2) | Trade name Larben 1040 (produced by Columbia Carbon Co.; oil absorption 105 ml/100 g) | 7 parts |

The above materials were well mixed under stirring and treated similarly as in Example 1 to obtain a toner according to this invention with an average particle size of 13.6 μ (hereinafter called as toner $G_3$).

For comparison, in place of the carbon black having the above composition, a mixture of 8 parts of Larben 1200 (produced by Columbia Carbon Co.; oil absorption 72 ml/ 100 g) and 8 parts of Larben 1170 (produced by Columbia Carbon Co.; oil absorption 58 ml/100 g ) was employed following otherwise the same procedure, to obtain a toner for comparative purpose with an average particle size of 13.7 μ hereinafter called as toner $H_3$).

The characteristic vales of the toners $G_3$ and $H_3$ are listed in Table 15.

TABLE 15

| Characteristic values: | Toner: Toner $G_3$ | Toner $H_3$ |
|---|---|---|
| Softening point (°C.) | 123 | 122 |
| Softening initiating temperature (°C.) | 118 | 118 |
| Electroconductivity (℧/cm) | $2.8 \times 10^{-6}$ | $5.3 \times 10^{-6}$ |

As is apparent from Table 15, it can be understood that the difference between the softening point and the softening initiating temperature of the magnetic toner cannot be made 5° C. or more by the use of a combination of two or more carbon blacks with a difference in oil absorption of less than 15 ml/100 g.

When running tests were conducted similarly as in Example 1 by use of these toners $G_3$ and $H_3$, off-set phenomenon became marked after about 10,000 sheets of copies for the toner $H_3$, while no off-set phenomenon was observed for the toner $G_3$.

We claim:

1. A process for pressing transfer of a toner image utilizing an intermediate transfer member comprising the sequential steps of:

(i) forming toner image by a magnetic toner on a photosensitive member, (ii) transferring said toner image onto an intermediate transfer member positioned between said photosensitive member and a final transfer member by pressing transfer, and then (iii) transferring and simultaneously thermally fixing said toner image onto said final transfer member by pressing transfer, wherein said toner comprises a magnetic material and a binder resin and is characterized in that the difference between the softening point and the softening initiating temperature of said toner being 5° C. or more and by having an electroconductivity of $10^{-4}$ to $10^{-2}$ ℧/cm in a direct current field of 1000 V/cm.

2. The process of claim 1, wherein said intermediate transfer member has a surface selected from the group consisting of natural rubber, urethane rubber, styrene-butadiene rubber, silicone rubber, ethylene-propylene rubber and fluorine rubber.

3. The process of claim 1, wherein said softening point is within the range of from 80° C. to 170° C.

4. The process of claim 3, wherein the fixing temperature is within the range of ±50° C. of said softening point.

5. The process of claim 4, wherein said intermediate transfer member has a surface selected from the group consisting of natural rubber, urethane rubber, styrene-butadiene rubber, silicone rubber, ethylene-propylene rubber and fluorine rubber.

* * * * *